United States Patent [19]

Elieff

[11] Patent Number: 4,967,454

[45] Date of Patent: Nov. 6, 1990

[54] SHOE CLOSURE SYSTEM AND METHOD

[76] Inventor: Paul J. Elieff, 2 Country View Ct., Wentzville, Mo. 63385

[21] Appl. No.: 312,539

[22] Filed: Feb. 17, 1989

[51] Int. Cl.[5] ..... A43C 7/00

[52] U.S. Cl. ..... 24/712.1; 24/713.1

[58] Field of Search ..... 36/50; 24/712.1, 712.2, 24/712.5, 303, 715.4, 713, 713.1, 713.8, 117, 118, 119

[56] References Cited

U.S. PATENT DOCUMENTS

| | | | |
|---|---|---|---|
| 376,041 | 1/1888 | Murdock | 24/143 R |
| 439,661 | 11/1890 | Horton | 24/117 R |
| 509,707 | 11/1893 | Vachon | 24/712.1 |
| 2,359,229 | 9/1944 | Lord | 24/121 |
| 2,612,135 | 9/1952 | Iny | 24/117 R |
| 2,659,169 | 11/1953 | Brennan | 24/303 |
| 2,693,654 | 11/1954 | Clark | 24/303 |
| 2,845,673 | 8/1958 | Weis | 24/121 |
| 2,869,204 | 1/1959 | Mopps | 24/117 R |
| 2,961,727 | 11/1960 | Coffey | 24/143 R |
| 3,074,135 | 1/1963 | Brodowski | 24/117 |
| 3,103,725 | 9/1963 | Robb et al. | 24/712.5 |
| 3,108,385 | 10/1963 | Teufel | 36/50 |
| 3,208,164 | 9/1965 | Hoyt, Jr. | 24/712.2 |
| 3,321,815 | 5/1967 | Herdman | 24/119 |
| 3,559,251 | 2/1971 | Wilson | 24/143 R |
| 3,845,575 | 11/1974 | Boden | 36/50 |
| 4,033,013 | 7/1977 | Peterson | 24/303 |
| 4,112,551 | 9/1978 | Sales | 24/712.5 |
| 4,393,550 | 7/1983 | Yang et al. | 24/117 R |
| 4,458,373 | 7/1984 | Maslow | 12/142 |
| 4,553,293 | 11/1985 | Blum | 24/119 |
| 4,680,835 | 7/1987 | Horng | 24/117 R |
| 4,790,048 | 12/1988 | Arnt | 24/712.1 |

FOREIGN PATENT DOCUMENTS

| | | | |
|---|---|---|---|
| 641539 | 2/1937 | Fed. Rep. of Germany | 24/117 R |
| 891065 | 9/1953 | Fed. Rep. of Germany | 24/117 R |
| 62922 | 6/1955 | France | 24/117 R |
| 38186 | 1/1915 | Sweden | 24/117 R |
| 58406 | 3/1925 | Sweden | 24/117 R |
| 244030 | 8/1946 | Switzerland | 36/50 |
| 285465 | 9/1952 | Switzerland | 36/50 |
| 2021383 | 12/1979 | United Kingdom | 36/132 |

*Primary Examiner*—Victor N. Sakran

*Attorney, Agent, or Firm*—Grace J. Fishel

[57] ABSTRACT

A shoe closure system and method for a lace tied shoe which eliminates the need for tying a bow and which does not slip off the lace. The lace is secured by a movable clutch which is captivated on a lace by a stop securely attached to the free ends of the lace and preferably releasably stuck to the shoe or to the lace adjacent the front of the shoe.

5 Claims, 2 Drawing Sheets

SHOE CLOSURE SYSTEM AND METHOD

The present invention relates to a shoe closure system and a method for tying a lace tied shoe wherein a movable clutch is securely captivated on a shoe lace.

BACKGROUND OF THE INVENTION

Laced shoes are very comfortable to wear because the user can tighten the laces to suit his preference and to compensate for stretching of the upper, swollen feet and so forth. One problem with laced shoes, however, is that they often become untied during use requiring the wearer to stop what he is doing and retie his shoes. This is especially a problem for young children who usually cannot tie their own shoes until they are about six or seven years old but who insist on doing things themselves and sometimes break the counter by stepping in and out without untying the bow.

Velcro closures address the problems associated with laced shoes but give the shoe an undistinguished appearance that lacks the decorative aspect or grown-up look of a lace. In addition, the ripping sound of opening the closure is distracting and irresistibly fascinating to children.

A number of difference devices have been proposed for clamping on bows to keep them from untying. These devices, however, do not eliminate the need for tying a bow. Other devices function as clutches to take the place of a bow. These latter devices, while obviating the need for tying a bow, are easily slid off the free ends of the lace and are therefore hazardous for young children. The shoe tying system described in U.S. Pat. No. 4,458,373 to Maslow partially confronts the latter objection by tying the free ends of the laces to the front of the shoe. For the Maslow system to work, however, the laces must be left long giving the shoes a sloppy appearance and the knot can be untied and the cord-lock slid off.

In view of the above, there is a need for a shoe closure system and method for tying which does away with the need to tie a bow and which does not slip off the lace. It is therefore an object of the present invention to provide such a system and method. Other objects and features will be in part apparent and in part pointed out hereinafter.

The invention accordingly comprises the constructions and methods hereinafter described, the scope of the invention being indicated in the following claims.

SUMMARY OF THE INVENTION

A shoe closure system and a method for tying a lace tied shoe wherein a movable clutch is threaded on the ends of a lace and held captive by a stop means securely attached thereto. In a preferred embodiment the ends of the lace are joined together and the stop means releasably stuck to the shoe or to the lace adjacent the front of the shoe.

BRIEF DESCRIPTION OF THE DRAWINGS

In the accompanying drawings, in which several of various possible embodiments of the invention is illustrated, corresponding reference characters refer to corresponding parts throughout the several view of the drawings and in which.

DETAILED DESCRIPTION OF THE INVENTION

Figure 1:
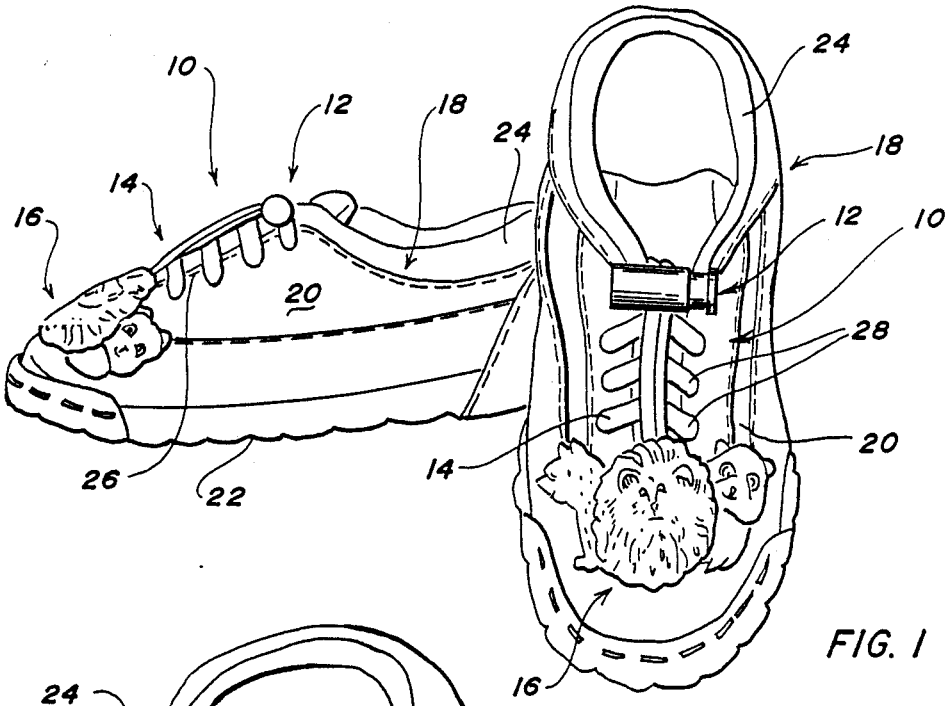
FIG. 1 is a top and side perspective view of a pair of shoes having a shoe closure system in accordance with the present invention.

Referring to the drawings more particularly by reference character, reference numeral 10 refers to a shoe closure system in accordance with the present invention including a movable clutch 12 held captive on a lace 14 by a stop means 16 located adjacent the free ends of the lace.

Figure 3:
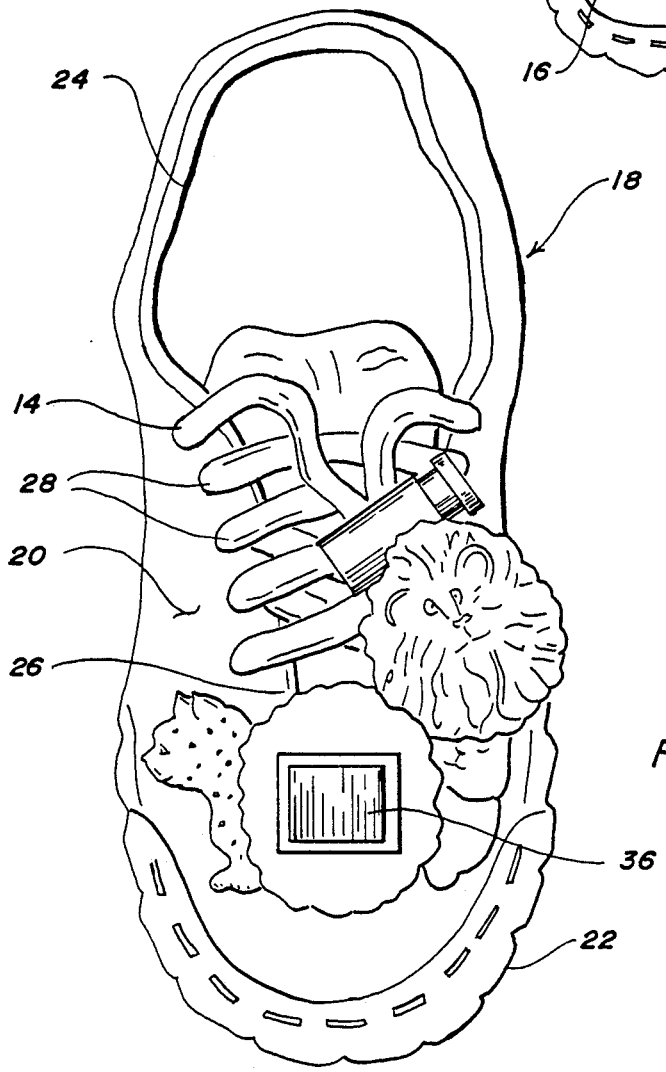
FIG. 3 is an enlarged top view of the right shoe as shown in FIG. 2 with the shoe closure system released.
Figure 2:
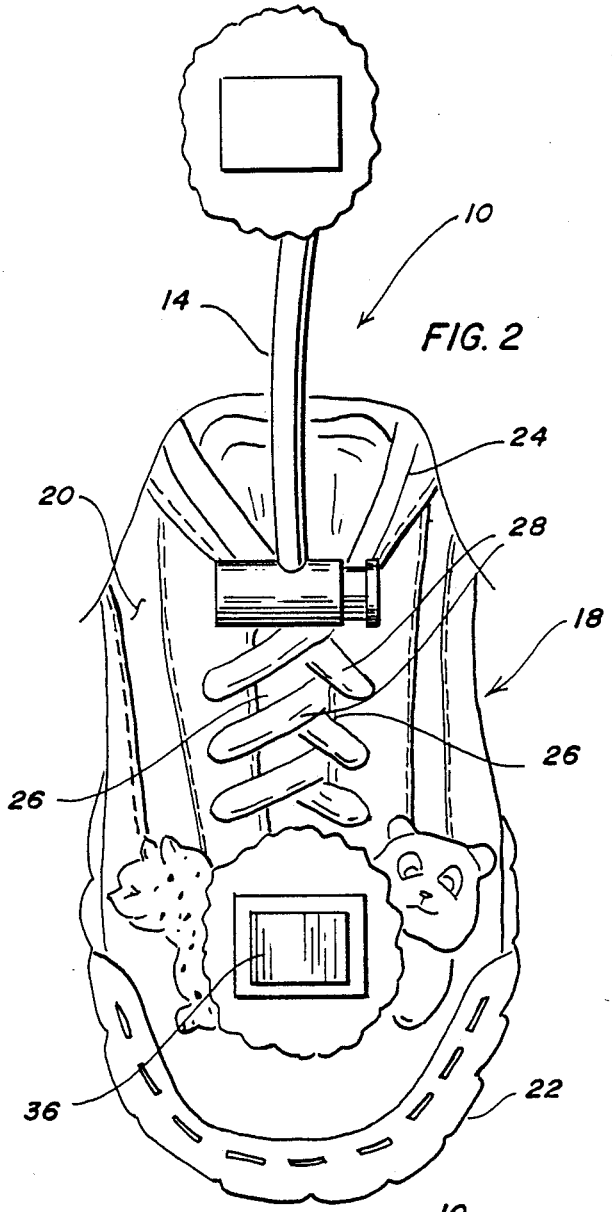
FIG. 2 is a top view of the right shoe partly broken away as shown in FIG. 1 with the free ends of the lace released.
Figure 4:
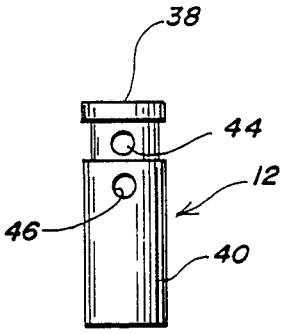
FIG. 4 is a side view of a cord-lock.
Figure 5:
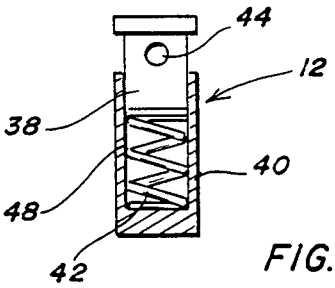
FIG. 5 is a sectional view taken along line 5—5 in FIG. 4.

As shown in FIGS. 1–3, a lace tied shoe 18 has an upper 20 attached to a sole 22 and forming a collar 24 about the foot of a wearer. The vamp of upper 20 is split at 26 with at least one lace hole 28 provided on each side thereof, more typically, however, provided in series with an equal number of holes on each side. Lace 14 is inserted through an opposing pair of lace holes 28 starting at the bottom of split 26 closest the front of the shoe and laced in a conventional manner through the series of lace holes that are provided. At the top of the split, the free ends of lace 14 extend through terminal lace holes 28 on each side of split 26 and then pass through and are retained by clutch 12 (e.g. clutches if a separate clutch is provided on each lace) which tightens upper 20 over the instep of the wearer.

Figure 6:
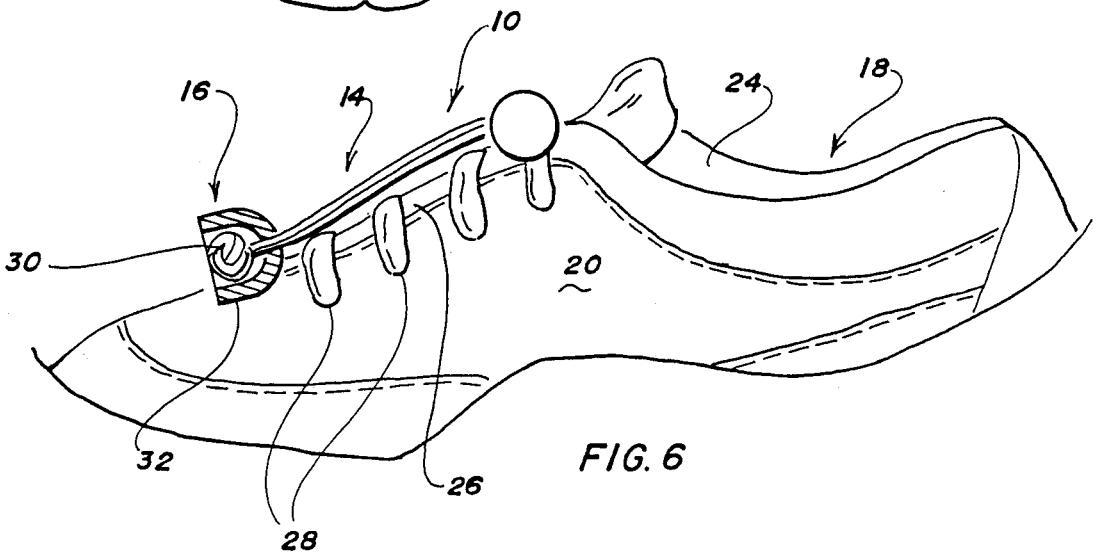
FIG. 6 is an alternative stop means for the clutch shown in section on a shoe.

The free ends of lace 14 are attached to stop means 16 which retain movable clutch 12 on the lace. Separate stop means can be provided on the free ends of each lace but it is preferred that the ends of lace 14 be joined by the stop. For safety and convenience, it is important that stop means 16 not be easily removable from lace 14 thus excluding the expedient of a simple knot but a shielded knot 30, as shown in FIG. 6, e.g. recessed in a bead 32 threaded on the free ends of lace 14 and preferably fused or coated such that it does not untie, may be used on shoes for all but the youngest of children. It is preferred, however, that the free ends of lace 14 be sewed, glued or otherwise securely attached to stop means 16 and that stop means 16 be releasably stuck to shoe 18 or to lace 14 adjacent the front of the shoe such that the free ends of the lace are dressed neatly against the laced portion of the lace as shown in FIG. 1. This preferred embodiment also keeps stop means 16 from bouncing at the ends of lace 14 when shoes 18 are worn.

Suitable means for releasably sticking stop means 16 to the shoe or the bottom of the lace release by pulling on the free ends of the lace adjacent the stop. As shown in FIG. 2, this can be accomplished in a variety of ways such as by attaching a magnet 34 to the underside of stop means 16 which is releasably attracted to a metal 36 fixedly attached to shoe 18 or to lace 14 adjacent the front of the shoe. Other releasable sticking means include Velcro, snaps, hooks and the like as will occur to those skilled in the art.

As shown in the drawings, clutch 12 is a cord-lock having a piston 38 inserted into a cylindrical base 40 which is closed at one end and open at the other. While clutch 12 is illustrated as a cord-lock, it can take the form of other movable means capable of grasping the free ends of lace 14 tightly such as a spring clamp or the like. With continuing reference to the drawings, cylinder 40 is filled with a coiled spring 42 which is compressed when the piston is pressed into the cylinder. The piston is provided with an opening 44 which, when the piston is pressed down into the cylinder compressing spring 42, matches an opening 46 near the open end of cylinder 40. When opening 44 is aligned with opening 46, the free ends of lace 14 may be inserted through the openings. When piston 38 is then released, spring 42 exerts upward pressure and clamps lace 14 in holes 44 and 46 preventing further movement of clutch 12 on lace 14.

Spring 42 is sized for close fit within cylinder 40 and the forward end of piston 38 is of reduced diameter 48 for close fit within the terminal coil of spring 42 to prevent piston 38 from being separated from cylinder 40 under normal circumstances. On the other hand, piston 38 can be released from spring 42 by pulling on it with sufficient force and exchanged for another piston 38 which may be formed of some other color or otherwise decorated to mix and match cylinder bases and pistons as desired when system 10 is disassembled.

In use, lace 14 which for children's shoes generally is too short to be tied into a bow is laced into lace tied shoe 18 through lace holes 28. The free ends of lace 14 are then threaded through movable clutch 12 and stop means 16 are securely attached so that the clutch is captivated on the lace and is movable between collar 24 of the shoe and the stop means. In a preferred embodiment stop means 16 is releasably stuck to the shoe or lace to keep the stop means from bouncing when the wearer takes a step.

In view of the above, it will be seen that the several objects of the invention are achieved and other advantageous results attained. As various changes could be made in the above constructions and methods without departing from the scope of the invention, it is intended that all matter contained in the above description or shown in the accompanying drawings shall be interpreted as illustrative and not in a limiting sense.

What is claimed:

1. A shoe closure system for a lace tied shoe, said shoe having an upper with a vamp, said vamp having a split with a bottom and at least one lace hole on each side thereof into which a shoe lace is laced, said shoe closure system comprising a movable clutch held captive on the free ends of the shoe lace by a stop means fixedly attached to the free ends of the shoe lace, said stop means releasably stuck to the shoe or the shoe lace near the bottom of the split on a length of lace such that the free ends of the lace are dressed neatly against the laced portion of the lace.

2. The system of the claim 1 wherein the means for releasable sticking the stop means are magnetic.

3. The system of claim 1 wherein the movable clutch is a cord-lock.

4. The system of claim 3 wherein the cord-lock includes a piston and a cylindrical base with a coiled spring closely fitted therein, said piston having a reduced diameter at its forward end for close fit within the terminal coil of the spring at the forward end of the piston.

5. A method for securing a lace tied shoe having an upper with a vamp, said vamp having a split with a bottom and at least one lace hole on each side thereof into which a shoe lace can be laced comprising:

(a) lacing a shoe lace through the lace holes;

(b) threading the free ends of the lace through amovable clutch;

(c) fixedly attaching a stop means to the free ends of the lace whereby the free ends of the lace are joined and the clutch is captivated on the lace;

(d) sliding the clutch on the shoe lace to tighten the laced portion of the lace; and, (e) releasable sticking the stop means to the shoe or the shoe lace near the bottom of the split on a length of lace such that the free ends of the lace are dressed neatly against the laced portion of the lace.

* * * * *